United States Patent [19]

Gaul

[11] 4,048,772

[45] Sept. 20, 1977

[54] MODULAR CRYPT SYSTEM

[76] Inventor: Michael F. Gaul, 2800 N. Lakeshore Drive, Chicago, Ill. 60657

[21] Appl. No.: 673,731

[22] Filed: Apr. 5, 1976

[51] Int. Cl.[2] ..... E04H 13/00

[52] U.S. Cl. ..... 52/136; 52/610; 52/236.3; 52/236.9

[58] Field of Search ..... 52/128–142, 52/610, 236, 29, 610, 236.3, 236.9, 79.1

[56] References Cited

U.S. PATENT DOCUMENTS

| | | | |
|---|---|---|---|
| 3,635,354 | 1/1972 | Martin | 52/610 |
| 3,642,339 | 2/1972 | Ruderfer | 52/134 |
| 3,643,814 | 2/1972 | Martin | 52/610 |

FOREIGN PATENT DOCUMENTS

| | | | |
|---|---|---|---|
| 285,699 | 9/1952 | Switzerland | 52/218 |

*Primary Examiner*—James L. Ridgill, Jr.

*Attorney, Agent, or Firm*—Hill, Gross, Simpson, Van Santen, Steadman, Chiara & Simpson

[57] ABSTRACT

A modular crypt system has adjacent columns comprised of substantially "inverted L" shaped modules, each module having substantially planar vertical and horizontal legs joined at ends thereof to define a corner. A corner reinforcement portion is provided on the inside adjacent surfaces of the legs, together with a notch portion on the outer edge of the vertical leg and adjacent the reinforcement portion. A tongue portion is formed at a free end of the module horizontal leg. The tongue portion of one module is supported in notch portions of an adjacent module. A column of stacked vertical end members is provided adjacent one of the modular columns with each vertical end member having a notch portion at a top end which support the tongue portion of adjacent "inverted L" shaped modules. A building roof is principally supported by the modular columns and end members.

7 Claims, 12 Drawing Figures

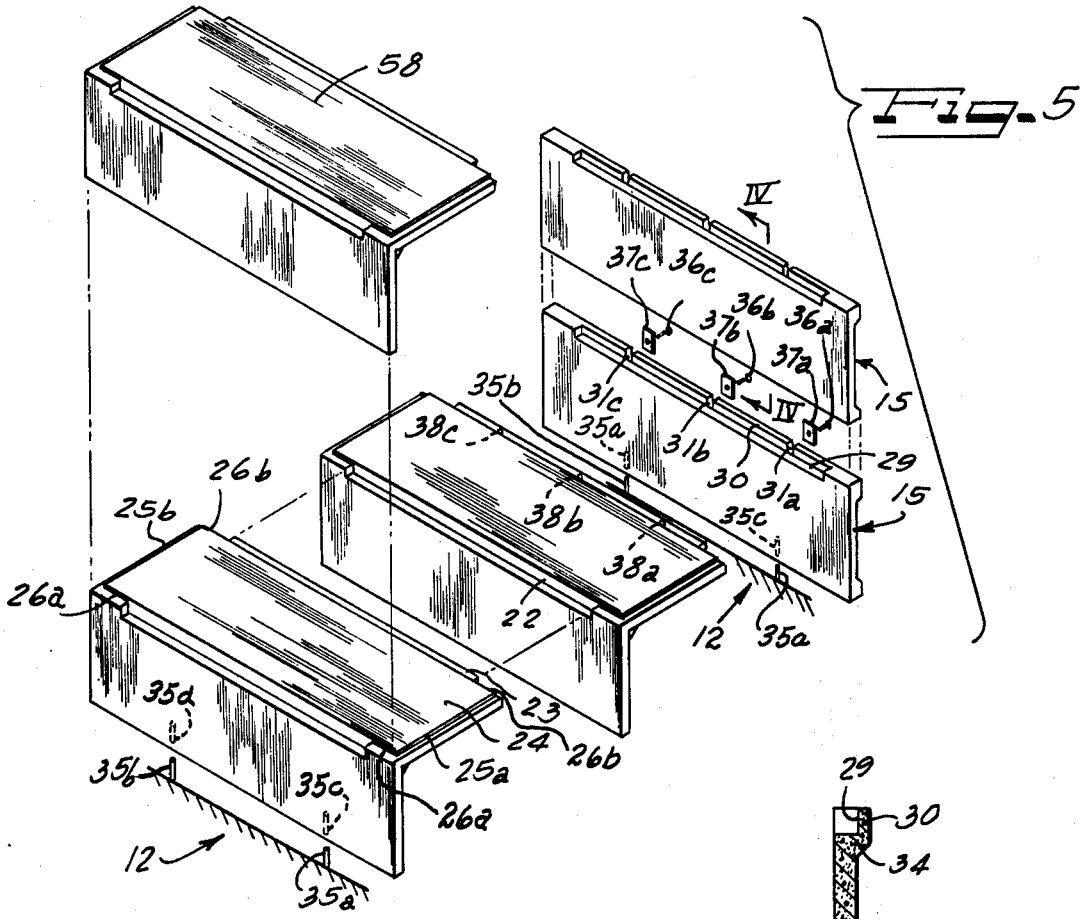
Fig. 5
Fig. 4
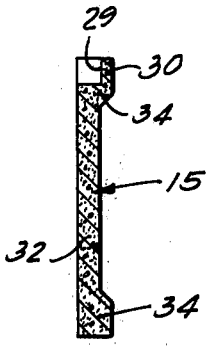
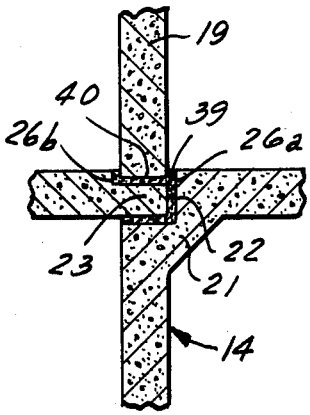
Fig. 6
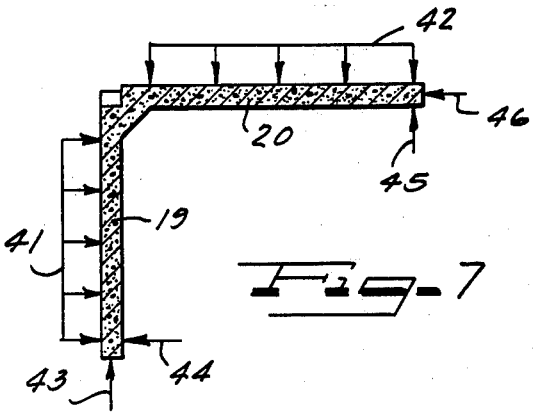
Fig. 7

Fig. 8
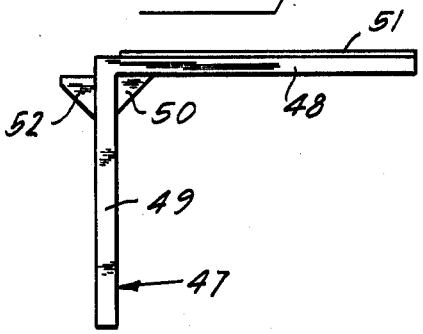
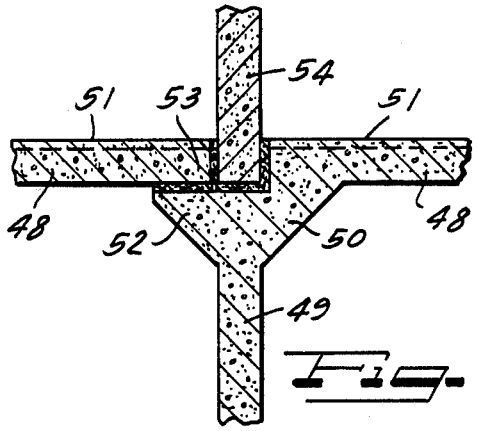
Fig. 10
Fig. 9
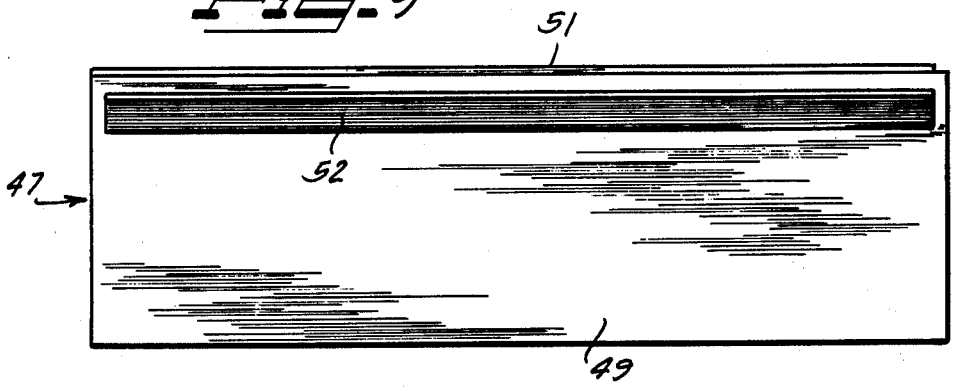
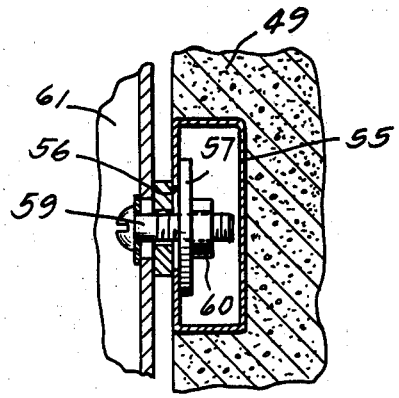
Fig. 11
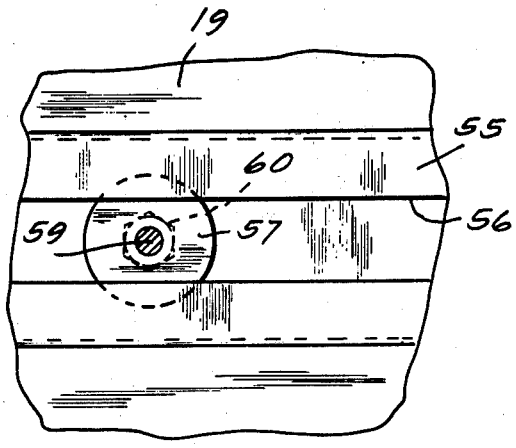
Fig. 12

MODULAR CRYPT SYSTEM

BACKGROUND OF THE INVENTION

1. Field of the Invention

This invention relates to an above-ground modular crypt system and in particular to a crypt system which is self-supporting.

2. Description of the Prior Art

Crypt structures have long been known in the prior art. The price of land in and near large metropolitan areas has provided a continuing problem for cemeteries providing underground burial service. The concept of employing an above-the-ground crypt structure has, accordingly, received careful attention. It permits the storage of remains in a substantially reduced acreage. Preferred crypt design calls for at least seven vertically stacked crypts whereas typical in-the-ground burial sites provide for a single layer of caskets and, accordingly, seven times more area.

Previously, a typical crypt construction called for the manufacture of a very substantial exterior building within which crypts were individually constructed. In such prior art systems, the exterior building walls provide substantially no crypt support, alignment, or other structural support. In my earlier U.S. Pat. No. 3,897,663, issued on Aug. 5, 1975, I disclose a novel crypt configuration in which the individual vertical walls of the crypt itself provide the structural support for the crypt building. Long vertical support members are provided between which horizontal slabs are laid. Such vertical support members, however, are not easily transported on a truck since they are relatively long and heavy. Furthermore, large numbers of support members cannot be closely packed on a truck.

U.S. Pat. No. 3,878,656, issued May 22, 1975 discloses the use of modules forming the walls and ceiling of approximately one and a half crypts. Each module is very heavy and does not permit close packing on a truck. These modules cannot be conveniently stacked to interleave with one another. Also, it is difficult to change the widths of individual crypts since such module configurations define both the sides and ceiling of the crypt. A form for creating such a shape cannot be easily widened. Furthermore, the crypts disclosed in this reference have a relatively smaller cross-sectional area and receive smaller caskets since two haunches are present within each so-configured crypt and thereby decrease the available space.

SUMMARY OF THE INVENTION

An object of this invention is to provide a modular crypt system in which individual modules are both light in weight and easily stackable on a truck in large quantities.

It is another object of this invention to provide the crypt structure which comprises a main structural support for an entire building.

It is a further object of this invention to provide a modular crypt system which is easily assembled.

The modular crypt system of this invention is comprised of columns of substantially "inverted L" shaped modules, each module having substantially planar vertical and horizontal legs joined at a first end of such legs to define a corner. A web-like corner reinforcement portion is provided between the inside adjacent surfaces of the legs and a notch portion is located adjacent the reinforcement portion at an outer edge of the first end of the vertical leg so that the notch portion is substantially aligned above the main body portion of the vertical leg. A tongue portion is formed at a second or free end of the horizontal leg of each module. This tongue portion is received within and supported by a notch portion of an adjacent module.

A column of stacked vertical end members is also provided adjacent one of the modular columns. Each vertical end member is column-shaped and has a notch portion at an inside edge of a top end thereof which receives and supports the tongue portion of a module in an adjacent column.

A roof or ceiling is principally supported by the columns formed of L-shaped modules and end members.

Each L-shaped module includes a raised floor portion. The floor portions of laterally adjacent modules cooperate with a notch portion of one of such adjacent modules to form a cavity for receiving the vertical leg of a vertically adjacent module.

Other objects, features and advantages of the invention will be apparent from the following detailed description of preferred embodiments thereof, taken in conjunction with the accompanying drawings.

BRIEF DESCRIPTION OF THE DRAWINGS

FIG. 4 is a sectional view taken along lines IV—IV of FIG. 5;

FIG. 5 is a perspective view illustrating the assembly of L-shaped modules together with corresponding vertical end members;

FIG. 6 is a fragmentary view illustrating detail of a typical joint for the modular crypt system of this invention;

FIG. 7 is a force diagram illustrating a static equilibrium condition for one module;

FIG. 8 is a front view of an alternate embodiment for an L-shaped module of this invention;

FIG. 9 is a side view of the module of FIG. 8;

FIG. 10 is a fragmentary view of a typical joint when the L-shaped module of the alternate embodiment is employed;

FIG. 11 is a fragmentary cross-sectional view of an anchoring system for front slab mounting; and FIG. 12 is a front view of the slab anchor of FIG. 11.

DESCRIPTION OF THE PREFERRED EMBODIMENTS

Figure 1:
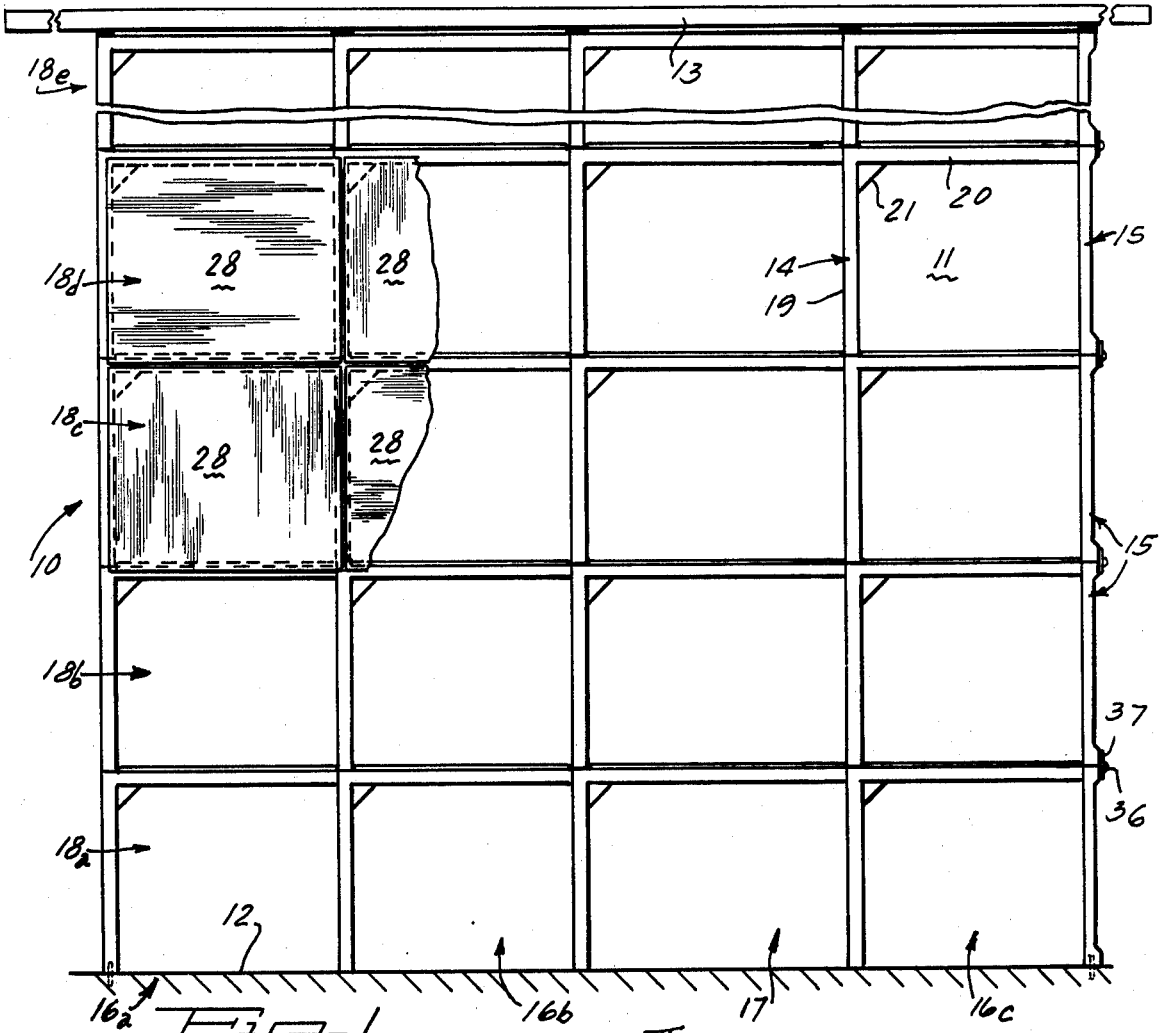
FIG. 1 is a front view of the modular crypt system of this invention fragmented to illustrate the upper end and roof of the assembly.

The preferred embodiment of an above-ground, self-supporting crypt assembly is shown generally at 10 in FIG. 1. Inverted L-shaped modules 14 combine with end members 15 to form individual crypts 11. A row **18*a* of crypts 11 are formed on a floor 12. A top row 18*e* supports a roof 13. Columns 16*a*, 16*b* and 16*c*, comprised of crypts having a standard width, are formed in the completed structure. If desired, however, a column 17 of crypts having an extended width may be provided adjacent columns 16*b* and 16*c* of normal width by forming the modules of column 17 so that such modules have a wider horizontal leg than the modules in the other columns. Slabs 28 cover the front of the crypts 11**.

Figure 2:
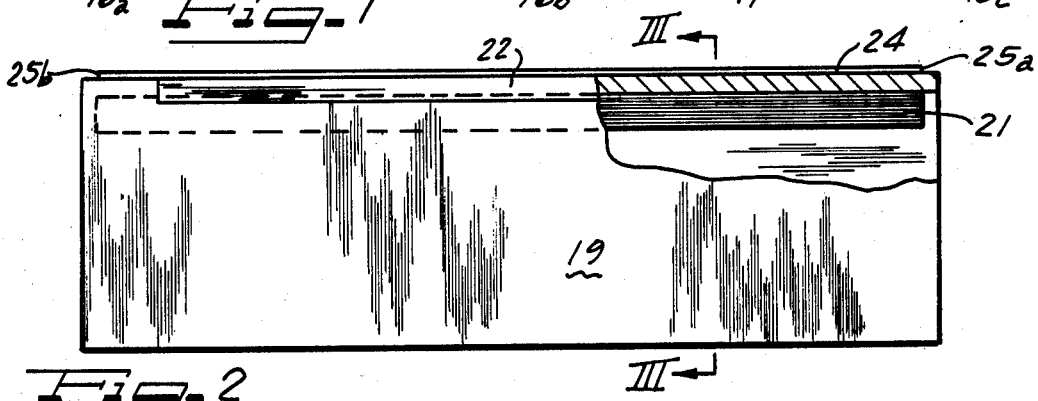
FIG. 2 is a side view of an "inverted L" shaped module used in the system of FIG. 1.
Figure 3:
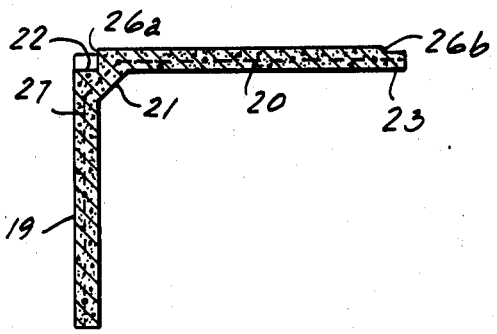
FIG. 3 is a cross-sectional view taken along lines III—III of FIG. 2.

Referring now to FIGS. 2, 3 and 5, construction details for the modules 14 and end members 15 will be discussed. Each module 14 includes a horizontal planar leg 20 and vertical planar leg 19 joined to one another at a first end of such legs to define a corner. A haunch or corner reinforcement 21 is provided as a web between inside adjacent surfaces of the horizontal and vertical legs. A rabbet or notch portion 22 is positioned at an outer upper edge of the first end of the vertical leg so as to be substantially aligned above the main body portion of the vertical leg, i.e., the notch portion is formed at the outside corner of the intersecting horizontal and vertical planar legs. The rabbet 22 may terminate as it approaches the respective side edges of the module 14 (best seen at FIG. 5). A tongue or reduced thickness portion 23 is provided at a free or second end of the horizontal leg 20 and includes an upper flat support surface located below the upper planar surface of leg 20.

A raised surface 24 (best seen at FIG. 5) may be provided on top of the upper planar surface of the horizontal leg 20. Surface 24 may be formed so as to define respective side edges 25*a* and 25*b* and respective end edges 26*a* and 26*b*.

The modules 14 are constructed by use of a form which is filled with a suitable construction material, such as concrete. A reinforcement 27 (best seen at FIG. 3) such as a wire mesh may be embedded within the construction material, such as concrete during the pouring thereof.

Structural details of end member 15 are most clearly illustrated in FIGS. 4 and 5. Each end member 15 is substantially column-shaped having upper and lower ends with a main body portion therebetween. Each column-shaped member 15 has a rabbet or notch portion 29 at an upper end of member 15, which is located along an inner upper edge thereof and is substantially aligned above the main body portion of member 15. A thin vertical wall 30 is formed by the rabbet 29. A plurality of slots 31*a*, 31*b* and 31*c* may be provided so as to extend from the upper edge of wall 30 of member 15 down to the upper flat surface of the notch portion 29.

A main body portion 32 of the end member 15 may have a reduced thickness as compared to the upper and lower portions 34 and 33, respectively of the member 15.

Assembly of the crypt system is most clearly shown in FIGS. 5 and 6. A floor 12 is provided with dowels 35*a* and 35*b* below alternate members 14 and end members 15. Such alternate module member 14 and end member 15 are each provided with suitable dowel-receiving apertures 35*c* and 35*d* respectively for receiving dowels 35*a* and 35*b* therein.

To form a bottom row of crypts 18*a*, alternate modules 14 and an end member 15 are mounted over the dowels 35*a* and 35*b*. Tongues 23 of modules 14 are positioned to engage and be supported by notches 22 of adjacent modules. The horizontal leg of the module adjacent the end member 15 is supported by positioning the tongue 23 of such module onto the rabbet or notch portion 29 of the end member 15.

The tongue portion 23 of the module which is supported by the initial end member 15 is provided with a plurality of insert openings 38*a*, 38*b* and 38*c* which are substantially aligned with slots 31*a*, 31*b* and 31*c* on the upper outer edge of member 15. Retaining means, such as bolts 36*a*, 36*b* and 36*c* having cooperating rectangular washers 37*a*, 36*b* and 37*c*, are positioned within the slots and the insert openings so as to maintain the upper end member in position above the initial or lower end member anchored to floor 12. Thereafter, a new row of crypts 18*b* comprised of modules 58 are assembled in a similar manner over the lower row of crypts 18*a*. Of course, additional rows of crypts, such as 18*c*, 18*d*, 18*e*, etc. may be assembled in a similar fashion, if desired.

As shown most clearly in FIG. 6, a typical joint in the assembled system is formed by initially placing a settable anchoring material, such as mortar 39 in the rabbet 22 of the module 14. A tongue 23 from a laterally adjacent module is placed into the mortar 39 on the rabbet 22. A bottom end 40 of vertical leg 19 of the vertically adjacent upper module is positioned in a cavity formed by an upper surface of the tongue 23, and end edges 26*a*, and 26*b*, of adjacent upper planar surfaces on adjacent horizontal legs of laterally adjacent modules.

Static equilibrium of a typical module 14 is best explained by reference to FIG. 7. Typically, a horizontal load 41 and vertical load 42 may be applied to the vertical and horizontal legs 19 and 20. The laterally adjacent modules and the vertically adjacent modules create reaction forces 43, 44, 45 and 46, respectively. The upper end of an adjacent vertical leg 19 provides the upward reaction force 43. A lateral reaction force 44 results from abutment with edge 26*a* of a laterally adjacent module. Upward reaction force 45 results from abutment with the vertical leg of a laterally adjacent module. Upward reaction also can occur from horizontal loading such as at the right end of each tier in a bank of crypts. Lateral reaction force 46 results from an abutment with edge 26*a* of a laterally adjacent module.

As shown in FIGS. 8 and 9, an alternate embodiment 47 for the modules has a horizontal planar leg 48 and vertical planar leg 49. Also, a corner reinforcement portion 50 is provided. A raised floor 51 is formed on the upper surface of the horizontal leg 48. In place of the notch or rabbet 22 of the previous embodiment, a right triangular ledge 52 is formed on an outside surface of the vertical leg 49 adjacent the reinforcement portion 50. Unlike the previous embodiment, an end portion 53 on the horizontal leg 48 does not have a reduced thickness. When the laterally adjacent modules 47 are combined, the end portion 53 rests upon ledge 52 of an adjacent module. As illustrated in FIG. 10, the end portion 54 of an upper module vertical leg 49 is laterally retained between raised floors 51.

To retain individual closure slabs 28 on the fronts of the crypts 11, a channel member 55 is, as shown in FIGS. 11 and 12, embedded horizontally in a front facing portion of vertical legs 49 or 19 of modules 47 or 14. A slot 56 is formed in the channel member 55 and a retaining member 57 is positioned across slot 56 and secured thereto by the combination of a threaded aperture 60 and retaining bolt 59. The bolt 59 fixedly and adjustably holds a vertical panel 61 in spaced relation with the modules and supports closure slabs 28 as described in my earlier Patent 3,897,663.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention, as defined in the appended claims.

I claim as my invention:

1. A modular crypt system adapted to provide the main structure support for a building, comprising:

a plurality of laterally adjacent inverted L-shaped modules, each module having a substantially planar load-bearing horizontal leg joined to a substantially planar load-bearing vertical leg at a respective first end of such legs so as to define a corner, said module having a web-like reinforcement portion joined with said legs between inside adjacent surfaces of said legs, said module having a notch portion position at an upper outer edge of said first end of the vertical leg, said notch portion being substantially aligned above said vertical leg and terminating at said first end of the horizontal leg;

a second end of the horizontal leg of one of said plurality of modules having a tongue portion extending therefrom, said tongue portion having an upper support surface located below an upper planar surface of said horizontal leg, said tongue portion being received and supported by a notch portion of a laterally adjacent module; and at least one substantially vertical column-shaped load-bearing end member having a notch portion at an upper inner edge of a top end thereof, said end member notch portion being substantially aligned above a main body portion of said end member and terminating at an outer upper edge thereof, said end member being positioned laterally adjacent an end module of said plurality of laterally adjacent modules so that said end member notch portion receives and supports a second end of the horizontal leg of said end module.

2. A modular crypt system comprising:

at least a first inverted L-shaped module having a substantially planar load-bearing horizontal leg joined to a substantially planar load-bearing vertical leg at a respective first end of such legs so as to define a corner, said module having a web-like reinforcement portion joined with said legs between inside adjacent surfaces of said legs, and said module having a notch portion positioned at an upper outer edge of said first end of the vertical leg, said notch portion being substantially aligned above said vertical leg and terminating at said first end of the horizontal leg;

at least one second inverted L-shaped module substantially identical to said first module, said second module being positioned laterally adjacent to said first module so that a notch portion of said second module receives and supports a second end of said second horizontal leg of the first module; and at least a first substantially vertical column-shaped end member having a notch portion at an upper inner edge of a top end thereof, said end member notch portion being substantially aligned above a main body portion of said end member and terminating at an outer upper edge thereof, said end member being positioned laterally adjacent to said second module so that said end member notch portion receives and supports a second end of said horizontal leg of the second module.

3. A modular crypt system comprising:

at least a first inverted L-shaped module having a substantially planar load-bearing horizontal leg joined to a substantially planar load-bearing vertical leg at a respective first end of such legs so as to define a corner, said module having a web-like reinforcement portion joined with said legs between inside adjacent surfaces of said legs, said module having a tongue portion at a second end of said horizontal leg, said tongue portion having an upper support surface located below the upper planar surface of the horizontal leg of said module, and said module having a notch portion positioned at an upper outer edge of said first end of the vertical leg, said notch portion being substantially aligned above said vertical leg and terminating at said first end of the horizontal leg; and at least a first substantially vertical column-shaped load-bearing end member having a notch portion at an upper inner edge of a top end thereof, said end member notch portion being substantially aligned above a main body portion of said end member and terminating at an outer upper edge thereof, said end member being positioned laterally adjacent to said first module so that said end member notch portion receives and supports said tongue portion of the first module.

4. A modular crypt system as defined in claim 3 including:

at least one second inverted L-shaped module substantially identical to said first module, said second module being positioned laterally adjacent to the vertical leg of said first module so that a notch portion of said first module receives and supports a tongue portion of said second module;

at least one third inverted L-shaped module substantially identical to said first module, said third module being positioned vertically adjacent to the horizontal legs of said first and second modules so that a bottom portion of the third module vertical leg is positioned within a cavity formed by the upper support surface of the tongue portion of said first module and the adjacent planar upper surfaces of the respective horizontal legs of said first and second modules; and at least one second vertical column-shaped load-bearing end member substantially identical to said first vertical end member, said second vertical end member being positioned vertically adjacent to said first vertical end member and laterally adjacent to said third module so that a notch portion of said second vertical end member receives and supports a tongue portion of said third module.

5. A modular crypt system adapted to provide the main structural support for a building, comprising:

a plurality of laterally adjacent columns, each column being formed of vertically adjacent substantially L-shaped modules, each module having a substantially planar load-bearing horizontal leg joined to a substantially planar load-bearing vertical leg at a respective first end of such legs so as to define a corner, said module having a web-like reinforcing portion joined with said legs between inside adjacent surfaces of said legs, a tongue portion at the second end of the horizontal leg of said module, said tongue portion having an upper flat support surface located below the planar upper surface of said horizontal leg, and said module having a notch portion positioned at an outer edge of said first end of the vertical leg, said notch portion being substantially aligned above said vertical leg and terminating at said first end of the horizontal leg;

a tongue portion of a module in one of said plurality of laterally adjacent columns being received in and supported by a notch portion of a module in a column positioned laterally adjacent to said one column, a bottom end of a vertical leg of a module located above a first row of modules in one of said plurality of laterally adjacent columns being received and supported by a cavity defined by the upper support surface of the tongue portion of a lower module located in a column positioned laterally adjacent to said one column; and at least one column of vertically adjacent substantially vertical column-shaped load-bearing end members, each end member having a notch portion at an upper inner edge of a top end thereof, said end member notch portion being substantially aligned above a main body portion of said end member and terminating at an outer upper edge thereof, each end member being positioned adjacent a module in a column of modules laterally adjacent said column of vertical end members so that each respective end member notch portion receives and supports a respective second end of the horizontal leg of the laterally adjacent module.

6. A modular crypt system as defined in claim 5 including a building roof member positioned on and supported by said columns of modules and end members.

7. A modular crypt system as defined in claim 5 wherein one of said plurality of columns of modules is formed of said L-shaped modules which have a horizontal leg that is wider than the horizontal leg of the modules in the other columns of modules.

* * * * *